US008720453B1

(12) United States Patent
Brown et al.

(10) Patent No.: US 8,720,453 B1
(45) Date of Patent: May 13, 2014

(54) HAIR CURLER WITH INTEGRATED HAIR CLAMPS

(71) Applicants: Thomas E. Brown, Simsbury, CT (US); Catherine S. Brown, Simsbury, CT (US)

(72) Inventors: Thomas E. Brown, Simsbury, CT (US); Catherine S. Brown, Simsbury, CT (US)

( * ) Notice: Subject to any disclaimer, the term of this patent is extended or adjusted under 35 U.S.C. 154(b) by 0 days.

(21) Appl. No.: 13/677,973

(22) Filed: Nov. 15, 2012

Related U.S. Application Data

(60) Provisional application No. 61/560,988, filed on Nov. 17, 2011.

(51) Int. Cl.

| | |
|---|---|
| ***A45D 24/00*** | (2006.01) |
| ***A45D 7/00*** | (2006.01) |
| ***A45D 2/24*** | (2006.01) |
| ***A45D 2/26*** | (2006.01) |
| ***A45D 2/00*** | (2006.01) |
| ***A45D 2/12*** | (2006.01) |
| ***A45D 2/16*** | (2006.01) |

(52) U.S. Cl.
CPC ... *A45D 7/00* (2013.01); *A45D 2/16* (2013.01)
USPC ..... 132/200; 132/256; 132/223; 132/226

(58) Field of Classification Search
CPC ..... A45D 7/00; A45D 2/16; A45D 2/12
USPC ..... 132/256, 200, 210, 212, 223–226, 230, 132/231, 232, 234, 235, 237, 242, 244, 245, 132/250, 252, 254, 255, 259–261, 263, 264, 132/266, 276, 277, 246, 247, 55, 56; D28/35, 37, 39, 40; 24/509, 510, 511
See application file for complete search history.

(56) References Cited

U.S. PATENT DOCUMENTS

| | | | | | |
|---|---|---|---|---|---|
| 1,310,557 | A | * | 7/1919 | Beadle | 132/245 |
| 1,719,232 | A | * | 7/1929 | Meade | 132/269 |
| 1,831,127 | A | * | 11/1931 | Martin | 132/242 |
| 1,928,960 | A | | 10/1933 | Behr | |
| 1,956,090 | A | | 4/1934 | Behr | |
| 2,137,595 | A | * | 11/1938 | Stubbs et al. | 132/247 |
| 2,200,624 | A | | 5/1940 | Jones | |
| D123,597 | S | * | 11/1940 | Izquierdo | D28/35 |
| 2,283,517 | A | | 5/1942 | Visitacion | |
| 2,408,657 | A | * | 10/1946 | Krasberg | 132/237 |
| 2,443,544 | A | | 6/1948 | Saucier | |
| 2,465,745 | A | * | 3/1949 | Orr et al. | 132/256 |
| 2,530,197 | A | * | 11/1950 | Hall et al. | 132/247 |
| 2,564,239 | A | * | 8/1951 | Voight | 132/106 |
| 2,599,505 | A | * | 6/1952 | Witmer | 132/131 |
| 2,608,977 | A | * | 9/1952 | Trippler | 132/242 |
| 2,655,926 | A | * | 10/1953 | Parrilla | 132/226 |

(Continued)

*Primary Examiner* — Vanitha Elgart
(74) *Attorney, Agent, or Firm* — Dan Shifrin

(57) ABSTRACT

A hair curler is provided having first and second hollow end tips. Each end tip has upper and lower clamping surfaces and has an open inner end. First and second spring clamps are within the first and second end tips, respectively. The first and second end tips are connected at their open inner ends. The first end tip is configured to hold one end of a lock of hair close to a user's scalp and the second end tip is configured to hold another end of the lock of hair after the lock of hair has been wound around the curler between the first and second end tips.

14 Claims, 4 Drawing Sheets

(56) References Cited

U.S. PATENT DOCUMENTS

| | | | | | |
|---|---|---|---|---|---|
| 2,730,109 | A | * | 1/1956 | Coakley et al. | 132/256 |
| 2,741,249 | A | * | 4/1956 | Oppman | 132/256 |
| 3,209,766 | A | | 10/1965 | Dannat | |
| 3,354,889 | A | | 11/1967 | Zeman | |
| 3,469,585 | A | | 9/1969 | Clifford | |
| 3,498,300 | A | | 3/1970 | Lehn | |
| 3,529,716 | A | | 9/1970 | O'Connell et al. | |
| 3,653,392 | A | | 4/1972 | Hassey et al. | |
| 3,779,255 | A | * | 12/1973 | Theodorides | 132/255 |
| 3,916,919 | A | | 11/1975 | Giordano | |
| 4,192,327 | A | | 3/1980 | Vasiliou | |
| 4,210,164 | A | | 7/1980 | Sidelman | |
| 4,270,554 | A | | 6/1981 | Lazzaro | |
| 4,286,608 | A | | 9/1981 | Handley et al. | |
| 4,291,714 | A | | 9/1981 | Mariani | |
| 4,513,761 | A | | 4/1985 | Van Deursen | |
| 4,598,722 | A | * | 7/1986 | Doyle | 132/226 |
| 4,955,401 | A | | 9/1990 | Parsons | |
| 5,101,842 | A | | 4/1992 | Ehmann | |
| 5,207,235 | A | * | 5/1993 | Muller et al. | 132/207 |
| 5,460,190 | A | | 10/1995 | Bondick | |
| 5,522,407 | A | | 6/1996 | Kelsey | |
| 5,819,761 | A | * | 10/1998 | Sloan | 132/210 |
| 5,884,635 | A | | 3/1999 | O'Brien et al. | |
| 6,191,387 | B1 | * | 2/2001 | Smal | 219/225 |
| 6,412,495 | B1 | | 7/2002 | Belman et al. | |
| 6,604,533 | B2 | * | 8/2003 | Hardenbrook et al. | 132/225 |
| 7,195,020 | B2 | | 3/2007 | Bird | |
| 7,296,580 | B1 | * | 11/2007 | Sbardella | 132/122 |
| D640,411 | S | | 6/2011 | Console | |
| D643,975 | S | | 8/2011 | Martinelli | |
| 2005/0076930 | A1 | * | 4/2005 | Yuen et al. | 132/132 |
| 2006/0076032 | A1 | * | 4/2006 | Fung | 132/224 |
| 2006/0137705 | A1 | | 6/2006 | Barrett | |
| 2007/0119474 | A1 | | 5/2007 | Strassmayer | |
| 2007/0209674 | A1 | | 9/2007 | Seidel | |
| 2008/0173322 | A1 | * | 7/2008 | Leung | 132/232 |
| 2008/0257373 | A1 | | 10/2008 | Cheung | |
| 2008/0314404 | A1 | | 12/2008 | Chan | |
| 2010/0116286 | A1 | | 5/2010 | O'Rourke | |

* cited by examiner

HAIR CURLER WITH INTEGRATED HAIR CLAMPS

RELATED APPLICATION DATA

The present application is related to commonly-assigned and U.S. Application Ser. No. 61/560,988, entitled HAIR CURLER WITH INTEGRATED HAIR CLAMPS, filed on Nov. 17, 2011, which application is incorporated herein by reference in its entirety.

TECHNICAL FIELD

The present invention relates generally to hair curlers and, in particular, to a hair curler with integrated hair clamps.

BACKGROUND ART

Currently hair curlers typically have separate components that are used to attach the curlers to hair such as hair clips, plastic covers that clip on, clasps attached to the curler and are secured by snapping onto fabric encased foam with wire ends that get folded over the hair before and after curling, or wire incorporated into a thin, pliable cylinder that folds over onto itself to hold curled hair. It may be difficult having various parts to keep track of and to handle. Integrated clasps may get in the way while winding hair, thereby getting tangled. Wire may not provide enough constant tension to keep hair from unraveling from the curler.

SUMMARY OF THE INVENTION

A hair curler is provided, comprising a curler body and a first clamp at a first end of the curler body. The first clamp comprises a first pair of clamping surfaces and a first bifurcating member, tension loaded to maintain the first clamping surfaces in a closed position. The curler also comprises a second clamp at a second end of the curler body, the second clamp comprising a second pair of clamping surfaces and a second bifurcating member, tension loaded to maintain the second clamping surfaces in a closed position. The curler also comprises a first indicator on the body above the first bifurcating member where a user presses against the tension release foci to open the first clamp to insert hair to be wound around the curler body and a second indicator on the body above the second bifurcating member where a user presses against the tension release foci to open the second clamp to clamp a free end of the wound hair.

In another embodiment, a hair curler is provided, comprising first and second hollow end tips, each comprising upper and lower clamping surfaces and having an open inner end. First and second spring clamps are within the first and second end tips, respectively. The first and second end tips are connected at their open inner ends. The first end tip is configured to hold one end of a lock of hair close to a user's scalp and the second end tip is configured to hold another end of the lock of hair after the lock of hair has been wound around the curler between the first and second end tips.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention generally provides a hair curler with an integrated hair clamping attachment.

Figure 1:
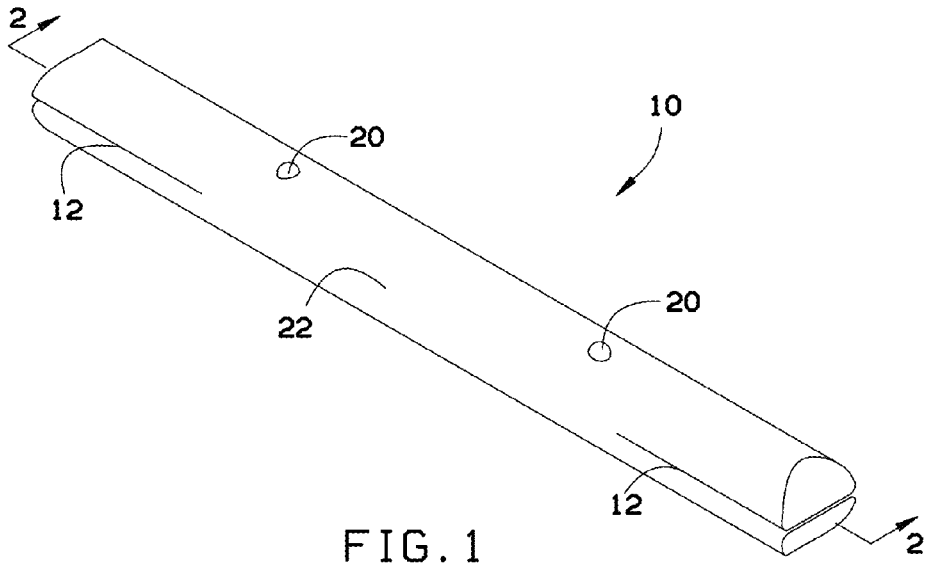
FIG. 1 is a perspective view of an embodiment of a hair curler of the present invention with the hair clamps shown in their closed position.
Figure 2:
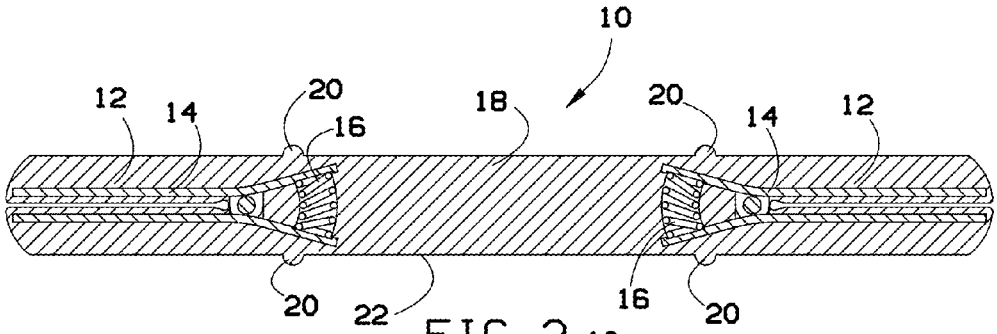
FIG. 2 is a section view of the hair curler of FIG. 1 taken along line 2-2 in FIG. 1.
Figure 4:
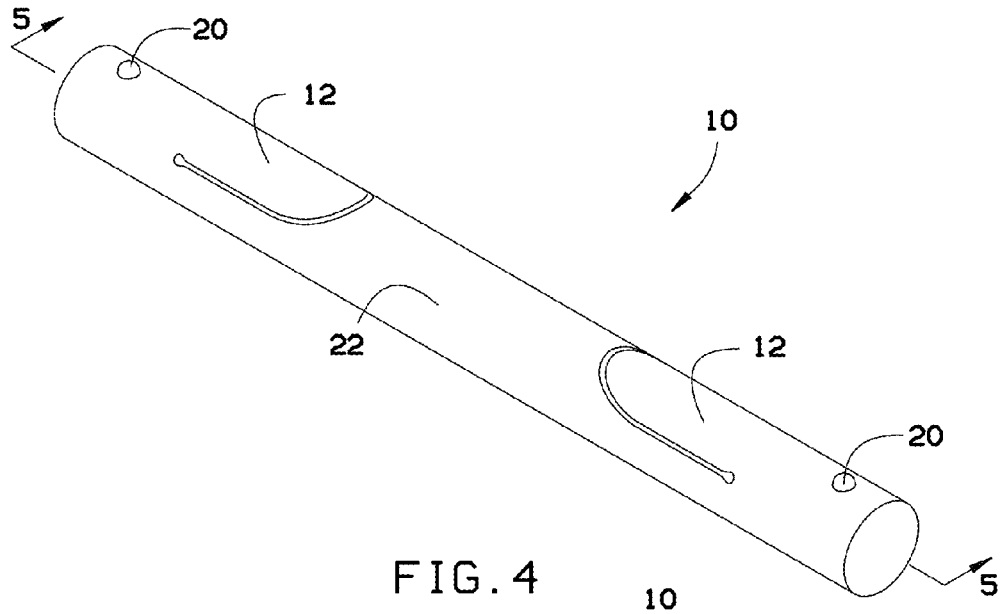
FIG. 4 is a perspective view of an alternate embodiment of a hair curler of the present invention with the hair clamps shown in their closed position.
Figure 5:
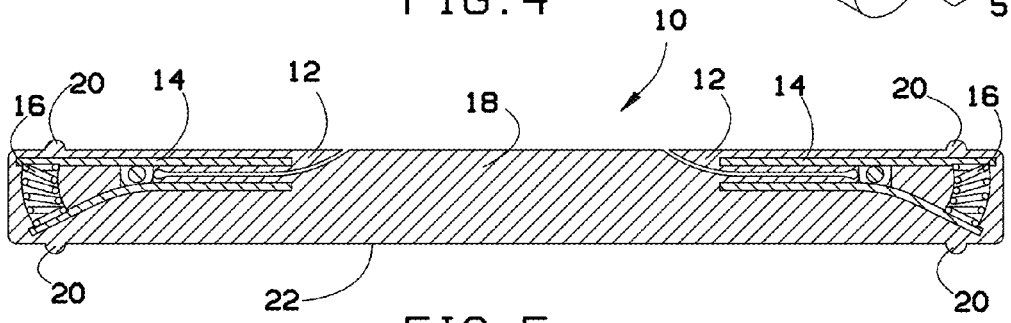
FIG. 5 is a section view of the hair curler of FIG. 4 taken along line 5-5 in FIG. 4.

FIG. 1 is a perspective view of an embodiment of a hair curler 10 of the present invention. The hair curler 10 may include an outward-facing hair clamp 12 on opposite ends of a body 18. Each clamp 12 may include a pair of bifurcating clamping surfaces 14 and a tension loaded member, such as a spring 16 or other material with tension load to maintain the clamping surfaces 14 in a closed position (FIGS. 1, 2, and 4). At the tension release foci, an indicator 20, such as a tactile member, may protrude from the body 18 above the spring 16 to indicate to the user where to press to open the clamps 12. Alternatively, the tension release foci indicators 20 may be marks printed onto or etched into the surface of the body 18 to provide a visual indicator of where to press to open the clamps 12. The body 18 may have a surface 22 which provides friction for holding hair that is wound around the curler 10.

FIG. 4 is a perspective view of an alternate embodiment of a hair curler 10 of the present invention in which the clamps 12 are inward-facing and the springs 16 and tension release foci indicators 20 are proximate to the ends of the body 18.

The curler 10 may be manufactured in different lengths and diameters and with different sized and positioned clamps 12 to accommodate hair of different lengths and curls of different sizes.

Figure 3:
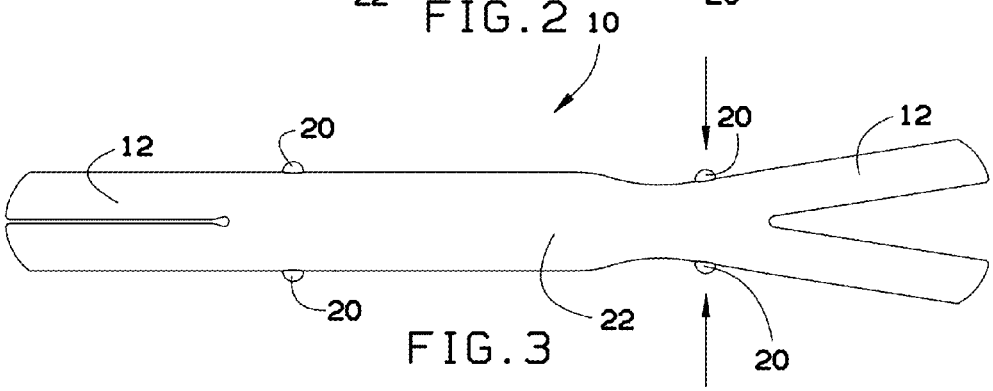
FIG. 3 is a front view of the hair curler of FIG. 1 with one hair clamp shown in the open position.
Figure 6:
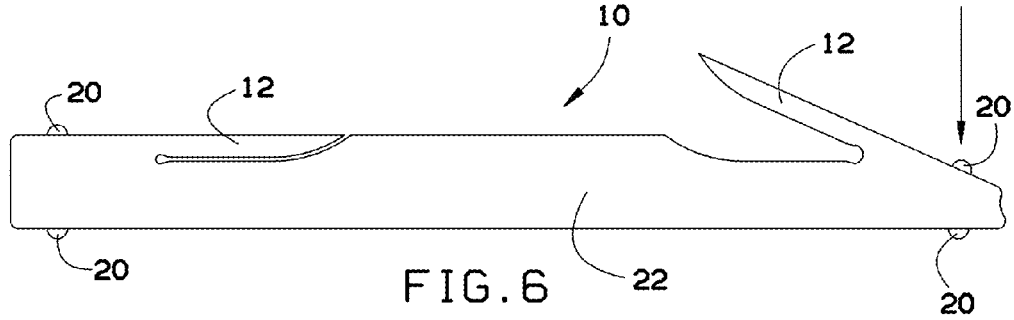
FIG. 6 is a front view of the hair curler of FIG. 4 with one hair clamp 12 shown in the open position.

To use, a person wishing to get a curl in their hair may select a lock of damp, dry, or conditioned hair. The user may select a curler of appropriate length for the length of hair and size of curl desired. The tension release foci indicator 20 at one end of the body 18 may be located and the clamp 12 at that end of the body 18 may be opened by pressing the body 18 against the tension of the spring 16 with the user's fingers to open bifurcating clamping surfaces 14 (FIGS. 3, 4, and 6). An upper end of the selected lock of hair may be placed between the bifurcating clamping surfaces 14 and the clamp 12 closed by releasing the fingers, thereby applying tension by the bifurcating clamping surfaces 14 against the hair. With the upper end of the selected lock firmly secured in the first clamp 12 on one end of the body 18 of the curler 10, the remaining hair of the selected lock may be wrapped around the body 18 multiple times, leaving enough hair at the lower, free end of the lock to secure in the second clamp 12 at the opposite end of the body 18.

While holding the hair-wrapped curler 10 in place with one hand, the second clamp 12 at the opposite end of the body 18 may be opened with the other hand and the end of the free end of the lock may be inserted between the opened bifurcating clamping surfaces 14; the second clamp 12 may then be released. The hair is securely wound in the curler 10 and held in place until it is removed from both clamps 12 of the curler 10. To remove the curler from the hair, the user may open either clamp 12 and unwind the curled lock, then open the other clamp 12 to free the curler from the hair.

Figure 7:
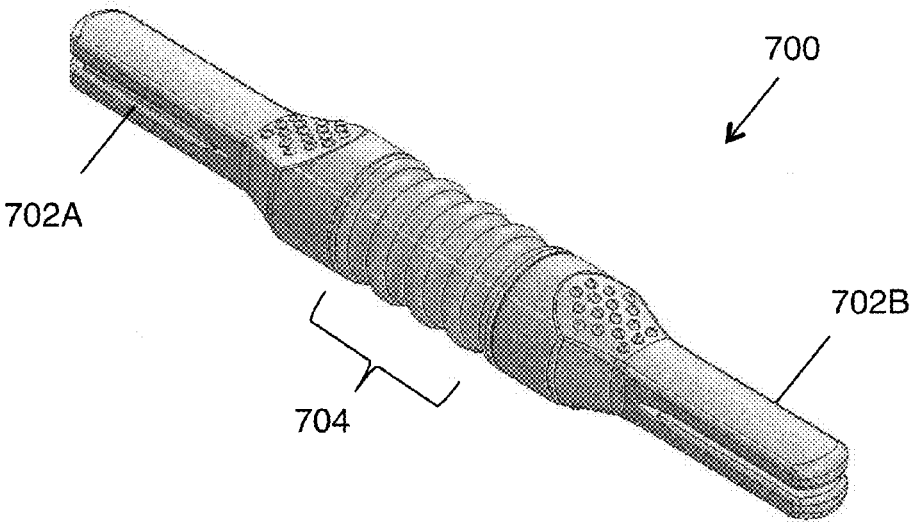
FIG. 7 is a perspective view of another alternate embodiment of a hair curler of the present invention.
Figure 8:
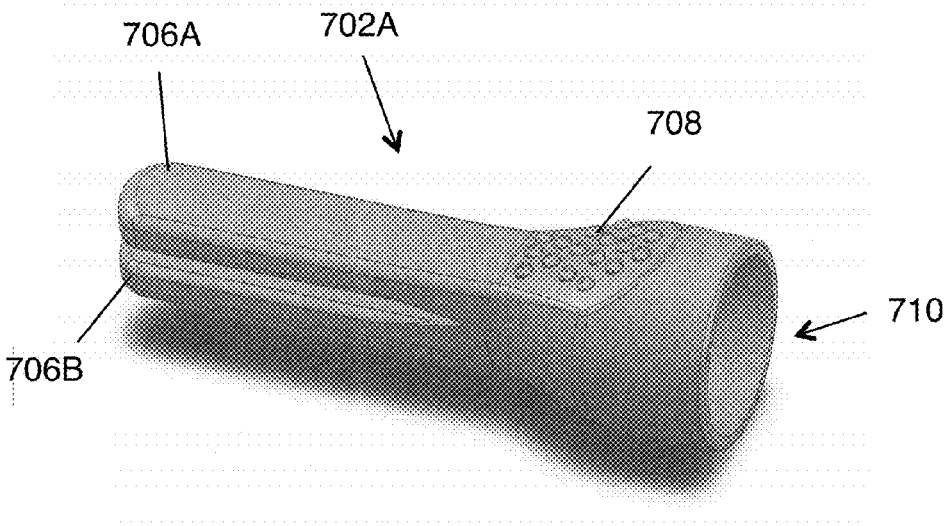
FIG. 8 is a perspective view of an end tip of the hair curler of FIG. 7.

FIG. 7 is a perspective view of another alternate embodiment of a hair curler 700 of the present invention. The hair curler 700 may include two end tips 702A, 702B. As illustrated in FIG. 8, the end tips 702A, 702B may be hollow with open inner ends 710 and formed from any appropriate waterproof and chemical-proof material, such as pliable rubber, silicon rubber, thermoplastic elastomer, or other pliable polymeric material. Each end tip may have upper and lower clamping surfaces 706A, 706B opposite the opening 710 and have tactile members 708 on the top and bottom.

Figure 9A:
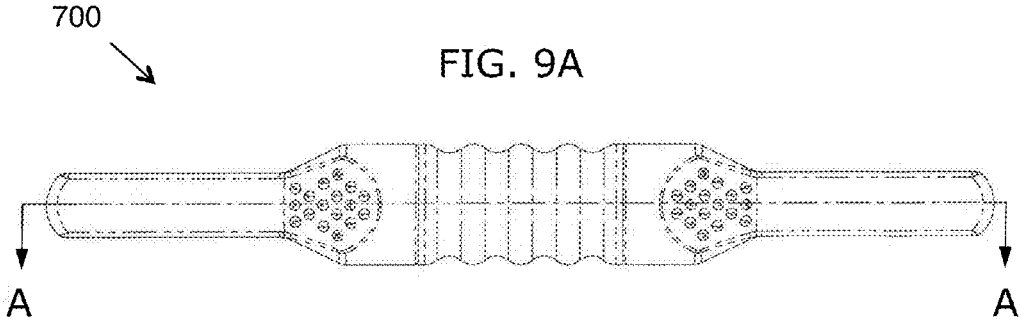
FIG. 9A is a top plan view of the hair curler of FIG. 7.
Figure 9B:
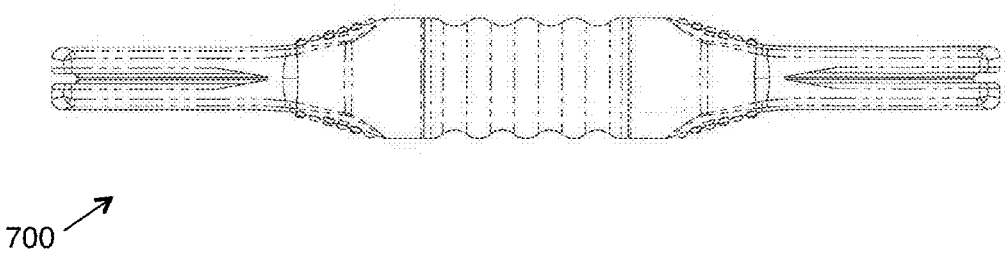
FIG. 9B is a side view the hair curler of FIG. 7.
Figure 9C:
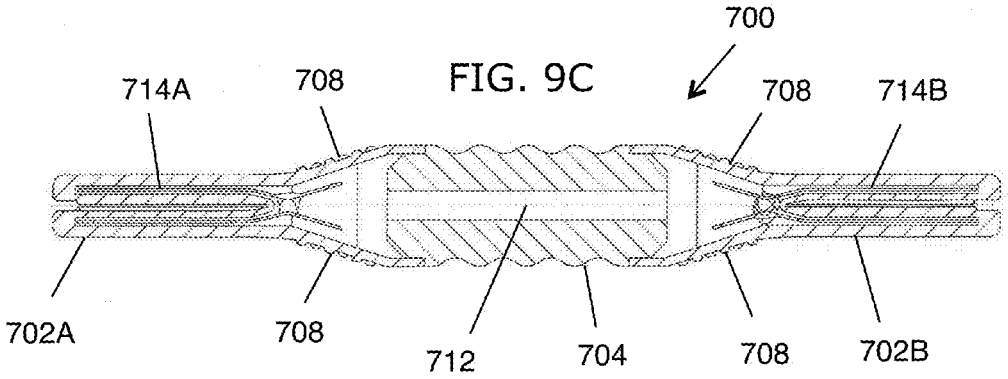
FIG. 9C is a cross-sectional side view the hair curler taken along line A-A in FIG. 9A.

The two end tips 702A, 702B may directly connected together, such as with a foam plug secured within the openings 710. The end tips 702A, 702B may also be connected with a middle extension section 704, which may be solid or have a hollow core 712 extending through the extension section 704 between the openings 710 of the end tips 702A, 702B, as illustrated in FIG. 9C. The extension section 704 may be straight or, as illustrated in the FIGs., may have grooves formed around its surface to facilitate air flow when drying hair in the curler 700. As further illustrated in FIG. 9C, a spring clip 714A, 714B may be inserted into the openings 710 of the end tips 702A, 702B.

If desired, shallow slits may be made in the clamping surfaces 706A, 706B to improve the ability of the clamping surfaces 706A, 706B to retain hair without it slipping out. The slits may be parallel to the length of the curler 700, or perpendicular to the length of the curler 700, or may be in a cross-hatch pattern. Alternatively, the clamping surfaces 706A, 706B may have ridges to help hold the hair.

The surface of the curler 700 may be any color, including colors that may blend into various hair colors, such as blonde, brunette, red, gray, so that the curler 700 is relatively inconspicuous. The surface of the curler 700 may also be a bright color to match clothing or as a fashion statement.

To assemble the hair curler 700, the two end tips 702A, 702B and the two spring clips 714A, 714B are provided. The spring clips 714A, 714B may be inserted into the openings 710 of the end tips 702A, 702B. The inner ends of the end tips 702A, 702B may then be secured to each other, either directly or with the middle extension section 704 between them.

To use, the user may press on the tactile members 708 on one of the end tips, such as the end tip 702A, to open the spring clip 714A. The user may insert a lock of hair between the clamping surfaces 706A, 706B, slide the end tip 702A close to the scalp, and release the spring clip 714A to hold the hair in place. The lock of hair may then be wound at least once around the curler 700 between the two end tops 702A, 702B and clamped using the spring clip 714B in the other end tip 702B. After the hair has dried or the user is otherwise satisfied with the curl, the hair may be released from both end tips 702A, 702B. It will be appreciated that the materials used to form the end tips 702A, 702B and the extension section 704 may be selected to be comfortable when the curler 700 is in place, including while sleeping.

Using the integrated clamps, the user of the curler of the present invention does not need other clips, covers, clasps, or wires to hold the curled hair, parts that may be difficult to keep track of or to handle while trying to curl hair.

It should be understood, of course, that the foregoing relates to exemplary embodiments of the invention and that modifications may be made without departing from the spirit and scope of the invention as set forth in the following claims.

What is claimed is:

1. A hair curler, comprising:

a curler body;

a first clamp at a first end of the curler body, the first clamp comprising:

a first pair of bifurcating clamping surfaces; and a first tension member, tension loaded to maintain the first pair of clamping surfaces in a closed position;

a second clamp at a second end of the curler body, the second clamp comprising:

a second pair of bifurcating clamping surfaces; and a second tension member, tension loaded to maintain the second pair of clamping surfaces in a closed position;

a first indicator on the body above the first tension member where a user presses to open the first clamp to insert hair to be wound around the curler body; and a second indicator on the body above the second tension member where a user presses to open the second clamp to clamp a free end of the wound hair.

2. The hair curler of claim 1, wherein the first and second clamps comprise spring clamps.

3. The hair curler of claim 1, where in the first and second clamps have outward-facing openings.

4. The hair curler of claim 1, where in the first and second clamps have inward-facing openings.

5. A hair curler, comprising:

first and second hollow end tips, each comprising upper and lower clamping surfaces and having an open inner end; and first and second spring clamps within the first and second end tips, respectively, the first and second spring clamps being tensioned to maintain respective upper and lower clamping surfaces in a closed position against each other, the upper and lower clamping surfaces having an open position when the first and second spring clamps are separated by pressure against a respective end tip;

the first and second end tips being connected at their open inner ends;

the first end tip configured to receive a first end of a lock of hair when the upper and lower clamping surfaces of the first hollow end tip are in the open position and hold the first end of the lock close to a user's scalp and the second end tip configured to receive a second end of the lock of hair when the upper and lower clamping surfaces of the second hollow end tip are in the open position and hold the second end of the lock after the lock of hair has been wound around the curler between the first and second end tips.

6. The hair curler of claim 5, further comprising a middle extension section secured between the open inner ends of the first and second end tips.

7. The hair curler of claim 6, wherein the middle extension section has grooves formed around a surface.

8. The hair curler of claim 5, wherein the first and second end tips are formed from a pliable polymeric material.

9. The hair curler of claim 8, wherein the pliable polymeric is selected from the group consisting of pliable rubber, silicon rubber, and thermoplastic elastomer.

10. The hair curler of claim 5, the first and second end tips further comprising tactile members on upper and lower surfaces indicating the locations of the tension release foci.

11. A method of assembling a hair curler, comprising:

providing first and second hollow end tips, each comprising upper and lower clamping surfaces and having an open inner end;

providing first and second spring clamps, the first and second spring clamps being tensioned to maintain respective upper and lower clamping surfaces in a closed position against each other, the upper and lower clamping surfaces having an open position when the first and second spring clamps are separated by pressure against a respective end tip;

inserting the first and second spring clamps into the open inner ends of the first and second end tips, respectively; and connecting the first and second end tips at their open inner ends.

12. The method of claim 11, wherein connecting the first and second end tips comprises connecting a middle extension section between the open ends of the first and second end tips.

13. The method of claim 11, wherein providing the first and second end tips comprises providing the first and second end tips formed from a pliable polymeric material.

14. The method of claim 13, wherein the pliable polymeric is selected from the group consisting of pliable rubber, silicon rubber, and thermoplastic elastomer.

* * * * *